United States Patent [19]

Rinkewich

[11] Patent Number: 5,052,620

[45] Date of Patent: Oct. 1, 1991

[54] LONG-RANGE WATER SPRINKLERS

[76] Inventor: Isaac Rinkewich, 48-22 Garden View Terrace, Hightstown, N.J. 08520

[21] Appl. No.: 528,396

[22] Filed: May 25, 1990

[51] Int. Cl.[5] ..... B05B 1/08

[52] U.S. Cl. ..... 239/101; 239/230; 239/DIG. 1

[58] Field of Search ..... 239/99, 101, 225.1, 239/230, 231, 232, 246, 97

[56] References Cited

U.S. PATENT DOCUMENTS

| | | | |
|---|---|---|---|
| 2,869,925 | 1/1959 | Crow | 239/230 |
| 3,204,873 | 9/1965 | Senninger | 239/230 |
| 3,765,608 | 10/1973 | Lockwood | 239/230 |
| 4,566,633 | 1/1986 | Rinkowich | 239/237 |
| 4,648,558 | 3/1987 | Rabitsch | 239/232 X |

FOREIGN PATENT DOCUMENTS

| | | | |
|---|---|---|---|
| 93509 | 3/1959 | Finland | 239/230 |

*Primary Examiner*—Andres Kashnikow
*Assistant Examiner*—Kevin P. Weldon
*Attorney, Agent, or Firm*—Benjamin J. Barish

[57] ABSTRACT

A rotary water sprinkler includes a plunger reciprocatable within the nozzle to restrict and englarge the nozzle throat so as to enable larger size nozzles to be used for obtaining a larger range, while the reciprocating plunger cyclically restricts and enlarges the nozzle discharge nozzle to restrict the discharge rate. The sprinkler further includes a pivotal arm impacted by the water jet and returned by a spring in order to reciprocate the plunger and also to rotate the sprinkler head.

15 Claims, 2 Drawing Sheets

LONG-RANGE WATER SPRINKLERS

FIELD AND BACKGROUND OF THE INVENTION

The present invention relates to water sprinklers, and particularly to the long-range water sprinklers described in my prior U.S. Pat. Nos. 4,534,510 and 4,566,633.

Both of the above patents disclose water sprinklers in which the range of the sprinkler is increased by providing a control member cyclically movable to restrict and enlarge the nozzle throat. Since the sprinkler range is directly proportional to nozzle size, the sprinklers described in those patents enable a larger size nozzle to be used for obtaining a larger range, but restrict the discharge rate by driving the control member to cyclically restrict and enlarge the nozzle throat.

OBJECT AND BRIEF SUMMARY OF THE PRESENT INVENTION

An object of the present invention is to provide a water sprinkler of the foregoing type but having an improved construction which can be manufactured in volume and at relatively low cost.

The present invention provides a water sprinkler of the foregoing type, comprising a sprinkler head mountable to a pressurized water supply line and rotatable with respect thereto about a rotary axis, a plunger reciprocatable within the nozzle through forward and return strokes to restrict and enlarge the nozzle throat; and a drive driven by the energy of the water for rotating the sprinkler head and reciprocating the plunger. According to the present invention, the drive includes: an arm pivotally mounted to the sprinkler head and having a jet impingement surface to be impinged by the water jet discharged from the nozzle for pivoting the arm in one direction, energy-storing means, such as spring for returning the arm in the opposite direction, an impact surface carried by the sprinkler head and engaged by the arm during its pivotal movements to apply a rotary movement to the sprinkler head about its rotary axis; and a coupling between the pivotal arm and the plunger for reciprocating the plunger through its forward stroke by the pivoting of the arm in the one direction, and through its return stroke by the pivoting of the arm in the opposite direction.

According to further features in a described preferred embodiment of the invention, the coupling comprises a pinion carried by the arm meshing with a rack carried by the plunger.

It will thus be seen that the water sprinkler constructed in accordance with the foregoing features utilizes an inpact arm, not only for rotating the sprinkler as previously used in impact-type rotary sprinklers, but also for reciprocating the plunger in order to restrict and enlarge the nozzle throat. Such an arrangement greatly simplifies the construction for reciprocating the plunger, as compared to the constructions described in the above-cited patents.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
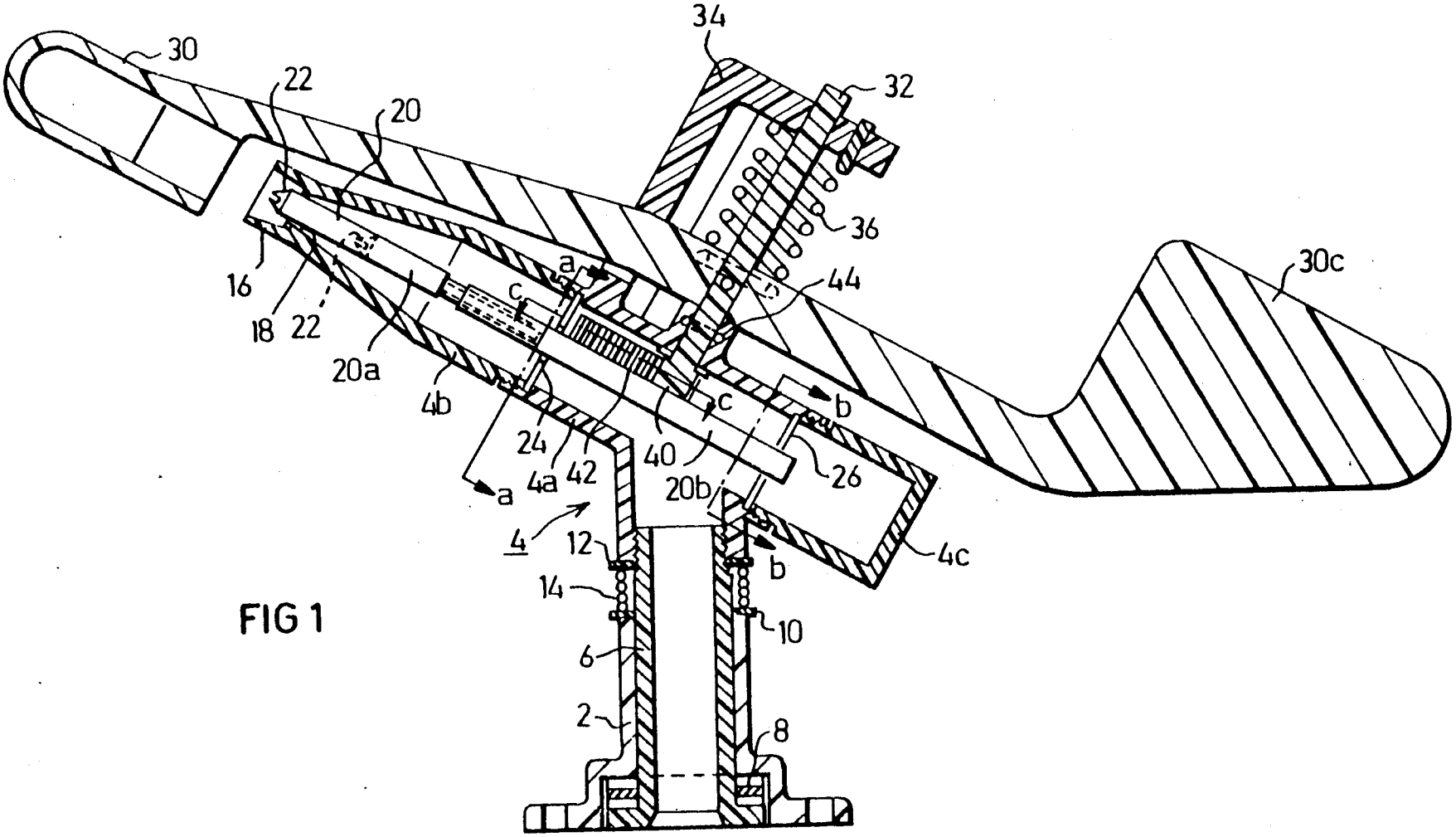
FIG. 1 is a longitudinal sectional view illustrating one form of water sprinkler constructed in accordance with the present invention.

The sprinkler illustrated in the drawings is of the type described in my previous two US patents referred to above. It comprises a fitting 2 mountable to a pressurized water supply line (not shown), and a sprinkler head, generally designated 4, including a sleeve 6 within fitting 2 and rotatably mounted with respect to the fitting. Sprinkler head 4 is rotatably mounted with respect to fitting 2 and the pressurized water supply line by a bearing 8 at the lower end of the fitting, and by a pair of bearings 10, 12 at the lower end of the sprinkler head, and separated by a coil spring 14.

Sleeve 6 serves as the inlet into the sprinkler head 4 for receiving pressurized water from the water supply line. The outlet from the sprinkler head 4 includes a nozzle 16 formed with a throat 18 for discharging the water in the form of a jet.

Sprinkler head 4 further includes a plunger 20 reciprocatable within the sprinkler head. Plunger 20 is formed with a conical tip 22 which is movable with respect to the nozzle throat 18 to restrict or enlarge the nozzle throat. Thus, when the plunger is in its fully extended position (as shown by the fulline position of conical tip 22 in FIG. 1), the plunger restricts the cross-sectional area of the nozzle throat 18, thereby reducing the discharge rate of the water jet flowing through nozzle 16, whereas when the plunger is in its fully retracted position (indicated by the broken-line position of its conical tip 22), the nozzle throat 18 is not restricted by the plunger, so that the discharge rate of the water jet is very high. As described in the above-cited patents, such a sprinkler is effective to increase the range of the water jet for a given discharge rate, since it enables the sprinkler to utilize larger-size nozzles for obtaining a larger range, but restricts the discharge rate by the reciprocatable plunger 20.

Figure 1B:
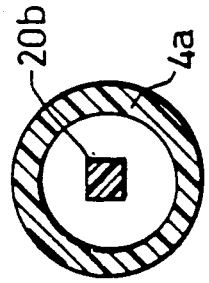
FIGS. 1*a*, 1*b* and 1*c* are sectional views along lines a—a, b—b and c—c, respectively, of FIG. 1.
Figure 1A:
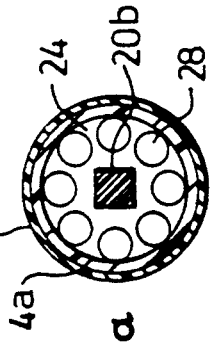
Figure 1C:
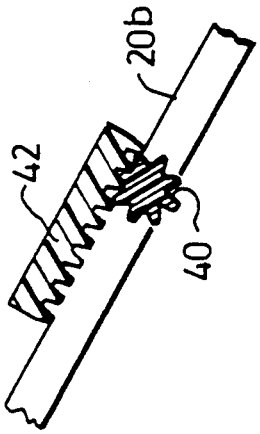

Plunger 20 is formed of two sections 20*a*, 20*b* in threaded telescoping relation to enable its conical tip 22 to be preset as desired with respect to the nozzle throat 18. The front section 20*a* of the plunger is preferably of cylindrical cross-section; but as shown particularly in FIGS. 1*a* and 1*b*, the rear section 20*b* is of square (or other polygonal) cross-section. The reciprocatory movements of the plunger are guided by a pair of discs 24, 26 secured within the sprinkler head 4 on opposite sides of its inlet sleeve 6.

Sprinkler head 4 is constituted of a main section 4*a*, a front section 4*b*, and a rear section 4*c*. The main section 4*a* is threaded on its front side to threadedly receive front section 4*b*, with disc 24 clamped between the two. Main section 4*a* is also threaded on its rear side to threadedly receive rear section 4*c*, with disc 26 clamped between the two.

Both discs 24 and 26 are formed with similar square-shaped openings for guiding the reciprocatory movements of the plunger 20 while preventing the plunger from rotating about its longitudinal axis. In addition, the front disc 24, located between the inlet sleeve 6 and the nozzle throat 18, is further formed with a circular array of openings 28 (FIG. 1*a*) around the square guiding opening, permitting the water to flow from the inlet to the nozzle.

The illustrated sprinkler includes a swingable impact arm, generally designated 30, pivotally mounted to the sprinkler head 4 and driven by the energy of the pressurized water in the water supply for applying impacts to the sprinkler head in order to rotate it about the longitudinal axis of its inlet sleeve 6. Impact arm 30 may be of the general type commonly used in rotary water sprinklers utilizing impact arms for rotating the sprinkler. In the illustrated sprinkler, however, the impact arm 30 is also utilized for reciprocating the plunger 20 with respect to the nozzle throat 18, so that both the reciprocations of the plunger, and the rotation of the sprinkler head, are effected by the energy of the pressurized water supplied to the sprinkler.

Figure 2:
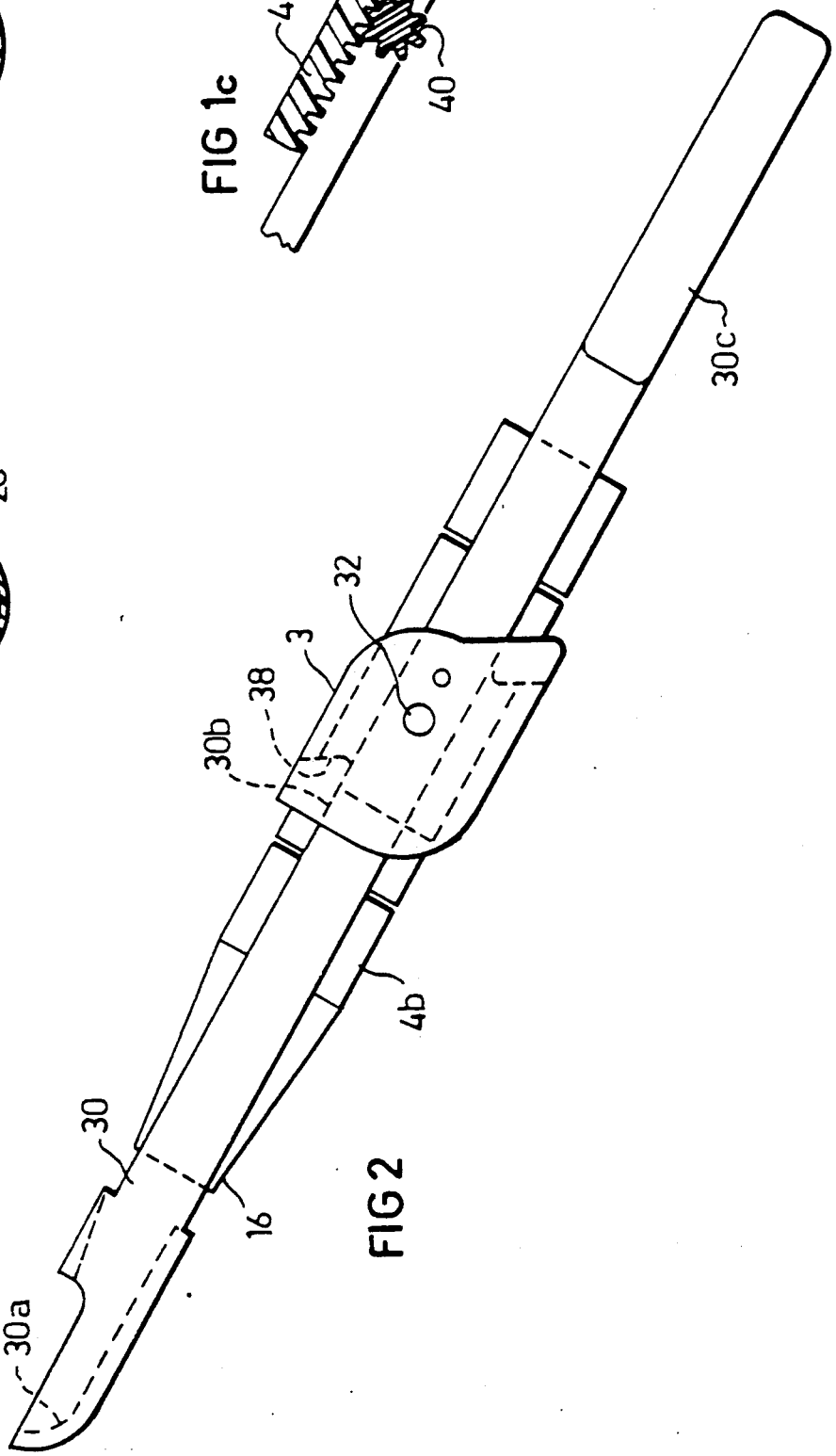
FIG. 2 is a top plan view of the sprinkler of FIG. 1.

Thus, arm 30 is fixed to a pivot pin 32 passing through an opening in the main section 4*a* of the sprinkler head 4. The opposite end of pivot pin 32 passes through an opening formed in an extension 34 integral with, or fixed to, the main section 4*a* of the sprinkler head. A coiled spring 36, having one end fixed to extension 34, and the opposite end fixed to arm 30, urges the arm so as to bring a jet-impingement surface 30*a* (FIG. 2) in alignment with nozzle 16 of the sprinkler head. When the arm is so located with respect to the nozzle, surface 30*a* is impinged by the jet issuing from the nozzle, which causes the arm to pivot about its pivot pin 32. Such pivoting of the arm loads spring 36, which serves as an energy-storing means to return the arm to its initial condition with respect to the nozzle 16.

Arm 30 includes an impact surface 30*b* which impacts against an impact surface 38 carried by the sprinkler head 4 to impart a rotary movement to the sprinkler head during each pivotal or swinging cycle of the arm. In the illustrated example, impact surface 30*b* of the arm impacts surface 38 of the sprinkler head at the end of the forward stroke of the arm as it is driven by the water jet. An alternative arrangement would be to have the impact surface of the arm impact against the sprinkler head at the end of the return stroke when it is returned by spring 36. The opposite end of impact arm 30 is enlarged, as shown at 30*c*, in order to balance the arm during its swinging movements.

As indicated earlier, the foregoing pivotal movements of arm 30 are also used for reciprocating plunger 20 with respect to the nozzle throat 18. For this purpose, pivot pin 32, fixed to arm 30, passes through the wall of the main section 4*a* of the sprinkler head 4 and is integrally formed with, or is fixed to, a pinion 40 within the sprinkler head. Pinion 40 meshes with a rack 42 integrally formed with plunger section 20*b*. A sealing ring 44 around the opening receiving the pivot pin 32 prevents leakage of water from the sprinkler head.

The operation of the illustrated sprinkler will be apparent from the above description.

Thus, the pressurized water, inletted via inlet sleeve 6 of the sprinkler head 4, is discharged in the form of a jet from nozzle 16. This jet impinges surface 30*a* (FIG. 2) of arm 30, causing the arm to swing about the axis of its pivot pin 32 thereby loading spring 36. During this pivotal movement of arm 30, its impact surface 30*b* impacts against impact surface 38 of the sprinkler head 4, thereby imparting a rotary movement to the sprinkler head about the longitudinal axis of its inlet sleeve 6. The pivotal movement of arm 30 in one direction reciprocates plunger 20 through its forward stroke with respect to nozzle throat 18 by the meshing of pinion 40 carried by pivot pin 32, with rack 42 carried by plunger section 20*b*; similarly, the pivotal movement of arm 30 in the opposite direction reciprocates plunger 20 through its return stroke with respect to nozzle throat 18, Thus, the energy within the pressurized water is used both to rotate the sprinkler head 4 with respect to the water supply line (not shown) to which it is connected, and also to reciprocate plunger 20 with respect to the nozzle throat 18, so that during each increment of rotation of the sprinkler head, the cross-sectional area of the nozzle throat 18 is cyclically restricted and enlarged.

In the illustrated example, the sprinkler is mounted with its rotary axis substantially vertical, and with the axis of its nozzle 16 and plunger 20 at an angle of approximately 10–30° with respect to the horizontal plane. In addition, arm 30 traverses an angle of between 40° and 160° about the pivotal axis of the arm, i.e., pivot pin 32. It will be appreciated, however, that the axis of the nozzle and plunger may be at different angles, and that the nozzle-plunger axis angle, and the traverse angle of the arm, may also be different according to any particular application. It will also be appreciated that the invention could be used in a sector-type sprinkler wherein the direction of rotation of the sprinkler head is periodically reversed. Many other variations, modifications and applications of the invention will be apparent.

What is claimed is:

1. A water sprinkler, comprising:

a sprinkler head mountable to a pressurized water supply line and rotatable with respect thereto about a rotary axis;

said sprinkler head including an inlet for receiving pressurized water from the water supply line, and a nozzle having a throat for discharging the water in the form of a jet;

a plunger reciprocatable within the nozzle through a forward stroke and a return stroke to restrict and enlarge the nozzle throat;

and a drive driven by the energy of the water for rotating said sprinkler head and reciprocating said plunger;

characterized in that said drive includes:

an arm pivotally mounted to said sprinkler head and having a jet impingement surface to be impinged by the water jet discharged from the nozzle for pivoting the arm in one direction;

energy-storing means for returning the arm in the opposite direction;

an impact surface carried by the sprinkler head and engaged by said arm during its pivotal movements to apply a rotary movement to the sprinkler head about its rotary axis;

and a coupling between said pivotal arm and said plunger for reciprocating the plunger through said forward stroke by the pivoting of the arm in said one direction, and through said return stroke by the pivoting of the arm in said opposite direction.

2. The sprinkler according to claim 1, wherein said latter coupling comprises a pinion carried by said arm meshing with a rack carried by said plunger.

3. The sprinkler according to claim 1, wherein said plunger includes a portion of polygonal section movable through an opening of a corresponding polygonal configuration to prevent rotation of the plunger during its reciprocations.

4. The sprinkler according to claim 3, wherein the reciprocations of the plunger are guided by two spaced discs both formed with openings of a polygonal configuration corresponding to the polygonal section of said portion of the plunger.

5. The sprinkler according to claim 4, wherein said two discs are fixed within said sprinkler head on opposite sides of its inlet, one of said two discs being located between the inlet and the nozzle and being formed with a circular array of openings around said polygonal opening for the flow of the water from the inlet to the nozzle.

6. The sprinkler according to claim 1, wherein said plunger is formed at one end adjacent said throat with a conical tip which restricts and enlarges the nozzle throat during the reciprocations of the plunger.

7. The sprinkler according to claim 1, wherein said nozzle and plunger are coaxially disposed at an angle of 10–30° with respect to the rotary axis of the sprinkler head.

8. The sprinkler according to claim 1, wherein said arm traverses an angle of between 40° and 160° during its pivotal movements.

9. A water sprinkler, comprising:

a sprinkler head mountable to a pressurized water supply line and rotatable with respect thereto about a rotary axis;

said sprinkler head including an inlet for receiving pressurized water from the water supply line, and a nozzle having a throat for discharging the water in the form of a jet;

a plunger reciprocatable within the nozzle through a forward stroke and a return stroke to restrict and enlarge the nozzle throat;

and a drive driven by the energy of the water for rotating said sprinkler head and reciprocating said plunger; said drive comprising:

an arm pivotally mounted to said sprinkler head and having a jet impingement surface to be impinged by the water jet discharged from the nozzle for pivoting the arm in one direction, and a spring for returning in the opposite direction;

an impact surface carried by the sprinkler head and engaged by said arm to apply a rotary movement to the sprinkler head about its rotary axis;

a pinion carried by said arm;

and a rack carried by said plunger and meshing with said pinion for reciprocating said plunger through said forward stroke by the pivoting of the arm in said one direction, and through said return stroke by the pivoting of the arm in said opposite direction.

10. The sprinkler according to claim 9, wherein said plunger includes a portion of polygonal section movable through an opening of a corresponding polygonal configuration to prevent rotation of the plunger during its reciprocations.

11. The sprinkler according to claim 10, wherein the reciprocations of the plunger are guided by two spaced discs both formed with openings of a polygonal configuration corresponding to the polygonal section of said portion of the plunger.

12. The sprinkler according to claim 11, wherein said two discs are fixed within said sprinkler head on opposite sides of its inlet, one of said two discs being located between the inlet and the nozzle and being formed with a circular array of openings around said polygonal opening for the flow of the water from the inlet to the nozzle.

13. The sprinkler according to claim 9, wherein said plunger is formed at one end adjacent said throat with a conical tip which restricts and enlarges the nozzle throat during the reciprocations of the plunger.

14. The sprinkler according to claim 9, wherein said nozzle and plunger are coaxially disposed at an angle of 10–30° with respect to the rotary axis of the sprinkler head.

15. The sprinkler according to claim 9, wherein said arm traverses an angle of between 40° and 160° during its pivotal movements.

* * * * *